US008677775B2

(12) United States Patent
Kim et al.

(10) Patent No.: US 8,677,775 B2
(45) Date of Patent: Mar. 25, 2014

(54) REFRIGERATOR HAVING AN IN THE DOOR ICE MAKER AND ICE CONTAINER ARRANGEMENT

(75) Inventors: Ju-Hyun Kim, Changwon (KR); Jong-Min Shin, Changwon (KR)

(73) Assignee: LG Electronics Inc., Seoul (KR)

( * ) Notice: Subject to any disclaimer, the term of this patent is extended or adjusted under 35 U.S.C. 154(b) by 900 days.

(21) Appl. No.: 12/518,790

(22) PCT Filed: Dec. 28, 2007

(86) PCT No.: PCT/KR2007/006984

§ 371 (c)(1),
(2), (4) Date: Jul. 29, 2009

(87) PCT Pub. No.: WO2008/082216

PCT Pub. Date: Jul. 10, 2008

(65) Prior Publication Data

US 2010/0005824 A1 Jan. 14, 2010

(30) Foreign Application Priority Data

Dec. 28, 2006 (KR) ..... 10-2006-0136183

(51) Int. Cl.
*F25C 5/18* (2006.01)

(52) U.S. Cl.
USPC ..... 62/344; 62/420

(58) Field of Classification Search
USPC ..... 62/344, 347, 407, 420, 430
See application file for complete search history.

(56) References Cited

U.S. PATENT DOCUMENTS

| | | | | |
|---|---|---|---|---|
| 4,655,951 | A * | 4/1987 | Hanazaki et al. | 252/70 |
| 4,955,676 | A * | 9/1990 | Weaver et al. | 312/407 |
| 5,375,432 | A * | 12/1994 | Cur | 62/320 |
| 6,758,047 | B1 * | 7/2004 | Giles | 62/66 |
| 7,681,406 | B2 * | 3/2010 | Cushman et al. | 62/72 |
| 8,161,766 | B2 * | 4/2012 | Shin et al. | 62/344 |
| 2003/0172670 | A1 * | 9/2003 | Vormedal | 62/407 |
| 2005/0061018 | A1 * | 3/2005 | Kim et al. | 62/344 |
| 2006/0032266 | A1 * | 2/2006 | Gagnon | 62/457.2 |

FOREIGN PATENT DOCUMENTS

| | | |
|---|---|---|
| KR | 10-2005-0028657 A | 3/2005 |
| KR | 10-2005-0028658 A | 3/2005 |
| KR | 10-2005-0100126 A | 10/2005 |
| KR | 10-2005-0100127 A | 10/2005 |

OTHER PUBLICATIONS

How Insulation Works; http://www.level.org.nz/passive-design/insulation/how-insulation-works/.*

* cited by examiner

*Primary Examiner* — Lakiya Rogers
(74) *Attorney, Agent, or Firm* — Birch, Stewart, Kolasch & Birch LLP

(57) ABSTRACT

A refrigerator has a container for storing ice surrounded by a cold accumulating member, so that when the container is provided in the refrigeration compartment, ice stored inside the container will not melt and stick together.

11 Claims, 5 Drawing Sheets

REFRIGERATOR HAVING AN IN THE DOOR ICE MAKER AND ICE CONTAINER ARRANGEMENT

TECHNICAL FIELD

The present disclosure relates to a refrigerator.

BACKGROUND ART

In general, a refrigerator is a home appliance that stores food at low temperatures to keep the food fresh for a prolonged period.

Specifically, a refrigerator provides a refrigeration compartment that maintains an inside temperature within a range of 1-4° C. to preserve foods such as vegetables in a fresh state, and a freezer compartment that maintains an inside temperature of around −18° C. to preserve foods such as meat and fish in a frozen state.

Refrigerators may be divided by type into refrigerators with the freezer compartment above the refrigeration compartment, refrigerators with the freezer compartment below the refrigeration compartment, and refrigerators with the freezer and refrigeration compartments provided beside one another.

Refrigerators can also be divided into french door refrigerators with doors mounted on the left and right, and top-bottom door refrigerators.

Some refrigerators have an ice maker for making ice provided on a side of the refrigeration or freezer compartment, and an ice bank for storing ice that is made.

In detail, when an ice maker and an ice bank are provided on the freezer compartment, water stored in the ice maker is converted to ice by refrigerant that passes through an evaporator, and the ice that is formed descends into and is stored in the ice bank provided below the ice maker.

In some refrigerators having ice makers provided in the refrigeration compartment, the ice bank is provided on a refrigeration compartment door. In this case, because the inside of the refrigeration compartment is maintained at temperatures above freezing, ice stored in the ice bank is prone to melt and stick together.

That is, when ice melts and sticks together, an ice crusher provided within the ice bank is subjected to an excessive load. More specifically, if the ice crusher is overloaded, components such as the motor driving the crusher and the crusher blades may be damaged. As a result, the service life of the ice bank is shortened, presenting added repair and replacement costs.

DISCLOSURE OF INVENTION

Technical Problem

According to an object of the present disclosure, there is provided a refrigerator that prevents ice stored in a container provided on a refrigeration compartment door from melting, and maintains the ice in a frozen state.

In detail, an object of the present disclosure is to provide a refrigerator that prevents ice stored in a container from melting and sticking together, thereby preventing damage to a crushing device for crushing ice.

Technical Solution

To achieve the above objects, embodiments of the present disclosure provide a refrigerator including: a main body provided with at least a refrigeration compartment; a door opening and closing the refrigeration compartment; an ice maker provided within the refrigeration compartment; a container provided at a rear surface of the door to store ice separated from the ice maker; and a cold accumulating member surrounding the container.

In another aspect of the present disclosure, there is provided a refrigerator including: a main body provided with a refrigeration compartment above a freezer compartment; a pair of doors pivotably provided at a front of the refrigeration compartment; an evaporator provided at a lower portion of a rear side of the main body; an ice maker provided in an upper region of the refrigeration compartment, and exposed to cold air within the refrigeration compartment; at least one shelf installed within the refrigeration compartment; a container provided at a rear surface of one of the doors on which the ice maker is installed, the container receiving and storing ice which is generated in and is dropped from the ice maker; and a cold accumulating member surrounding an inner periphery and/or an outer periphery of the container.

Advantageous Effects

In the above-configured refrigerator according to the present disclosure, even when a container for storing ice is provided on a refrigeration compartment door, ice is prevented from melting and sticking together.

Moreover, because ice does not melt and stick together, an ice crusher provided in the container is prevented from being overloaded.

In addition, because the ice crusher is not overloaded, components such as a driving motor that drives the ice crusher and a blade for crushing ice are not damaged. Therefore, the service life of the container is extended, reducing added costs for repair and replacement.

MODE FOR THE INVENTION

Reference will now be made in detail to specific embodiments of the present disclosure, with reference to the accompanying drawings. It should be understood, however, that the scope of the present disclosure is not limited to the embodiments described herein, and that through various additions, modifications, and deletions of elements, alternate embodiments that fall within the scope of regressive inventions or the present disclosure may be easily provided.

Figure 1:
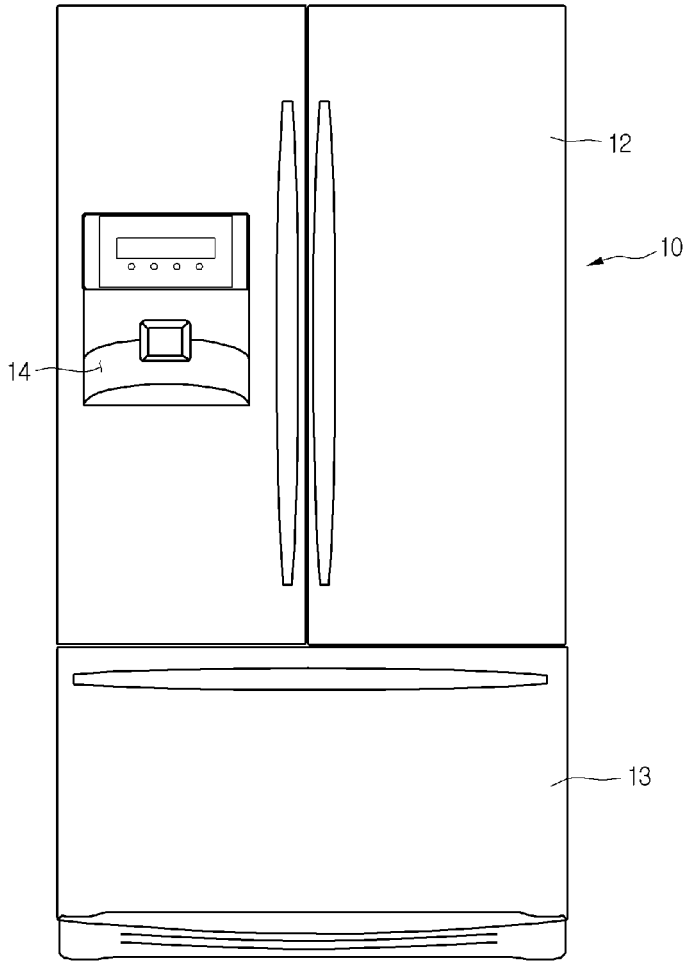
FIG. 1 is a frontal view of a refrigerator according to an embodiment of the present disclosure.
Figure 2:
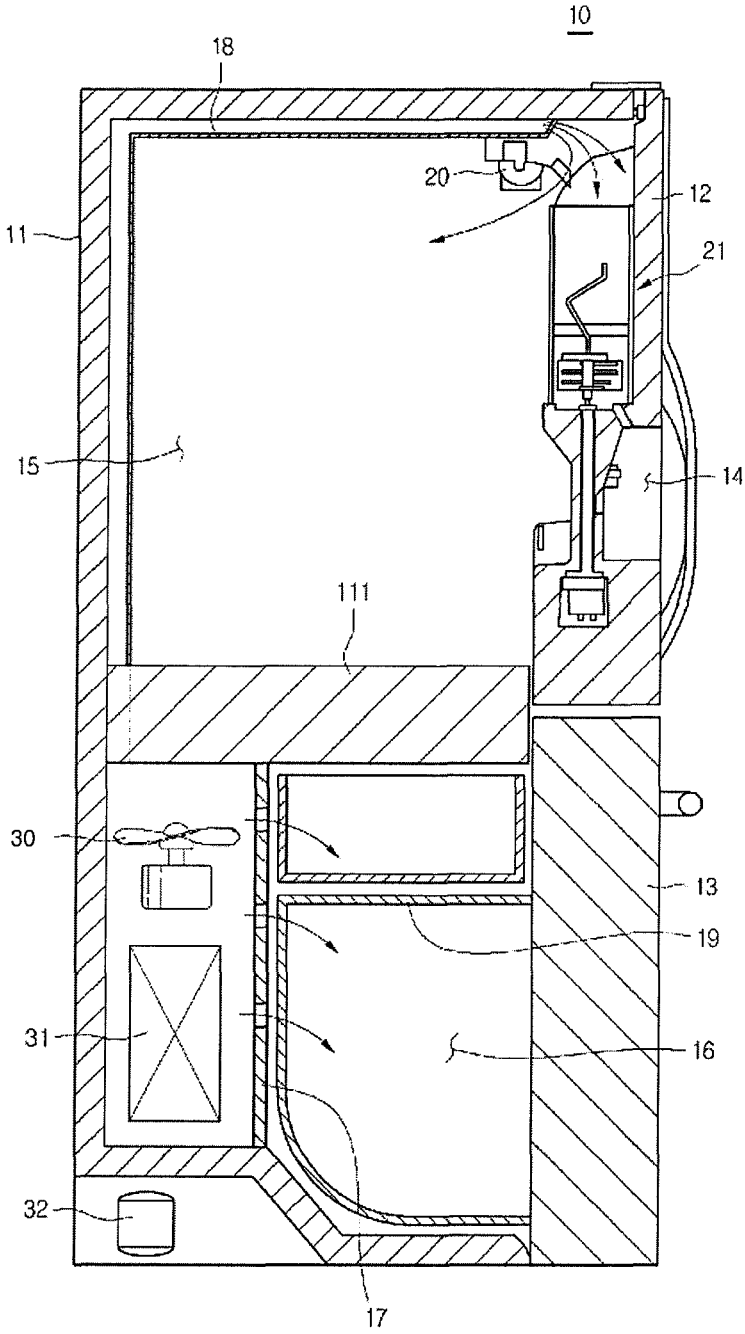
FIG. 2 is a side sectional view of a refrigerator according to an embodiment of the present disclosure.

FIG. 1 is a frontal view of a refrigerator according to an embodiment of the present disclosure, and FIG. 2 is a side sectional view of a refrigerator according to an embodiment of the present disclosure.

Referring to FIGS. 1 and 2, a refrigerator according to the present disclosure is exemplarily described as a bottom freezer refrigerator having the refrigeration compartment provided at the top and the freezer compartment provided therebelow.

In detail, a refrigerator 10 according to an embodiment of the present disclosure includes a main body 11 provided with a refrigeration compartment 15 and a freezer compartment 16 at the top and bottom of the main body, respectively, refrigeration compartment doors 12 opening and closing the refrigeration compartment 15, and a freezer compartment door 13 opening and closing the freezer compartment 16. That is, the refrigeration compartment 15 and the freezer compartment 16 are separated by a barrier 111.

An ice maker 20 is provided on a surface of the ceiling in the refrigeration compartment 15, and a refrigeration duct 18 extends along the wall and ceiling surfaces of the refrigeration compartment. Also, the refrigeration compartment doors 12 are pivotably installed on the left and right sides at the front of the main body 11, respectively. A dispenser 14 for dispensing water and ice is provided at the front of one of the refrigeration compartment doors 12.

The freezer compartment door 13 is provided as a drawer, and a removable basket 19 for storing frozen food is provided behind the freezer compartment door 13.

In detail, the frame of the door extends rearward from either side at the rear of the freezer compartment door 13, and the door frame and the sides of the freezer compartment door 16 are connected through rail members. Thus, the freezer compartment door 13 is horizontally withdrawable along the rail members.

An ice bank 21 for storing ice is mounted to the rear surface of the refrigeration compartment door 12 where the ice maker 20 is installed. Thus, the ice made by the ice maker 20 is separated and falls into the ice bank 21.

In detail, the top of the ice bank 21 is open, and the open portion of the ice bank 21 is disposed below the ice maker 20 when the refrigeration compartment door 12 is closed. Cold air may either directly be supplied to the ice maker 20 to make ice, or a separate refrigerant pipe may be provided for making ice. In the present embodiment, the ice maker 20 may be configured with a separate refrigerant pipe. When a refrigerant pipe is configured in the ice maker 20, it allows for a quicker ice making speed despite the ice maker 20 being exposed to the comparatively higher temperature inside the refrigeration compartment. Accordingly, in a refrigerator having an ice maker provided within the refrigeration compartment, it may be beneficial for the ice maker to be provided with a refrigerant pipe. The structure and operation of an ice maker 20 provided with a refrigerant pipe will be described in detail below with reference to the diagrams.

When an ice bank 21 is provided in a refrigeration compartment 15 or on a refrigeration compartment door 12, ice may melt and stick together due to the above-freezing temperature maintained within the refrigeration compartment 15.

To obviate the above limitation, the inside of the ice bank 21 should always be maintained at a sub-freezing temperature to prevent ice from melting. Below, a detailed description of a method for maintaining ice within the ice bank 21 in an unmelted state will be provided with reference to the drawings.

A refrigerator 10 according to an embodiment of the present disclosure further includes a compressor 32 that compresses refrigerant provided on the floor of the freezer compartment 16, an evaporator 31 for generating cold air disposed behind the freezer compartment 16, and a blower fan 30 for supplying the cold air generated by the evaporator 31 to the refrigeration compartment 15 and the freezer compartment 16.

The refrigerator 10 also includes a freezer duct 17 for supplying cold air blown by the blower fan 30 to the freezer compartment 16, and a refrigeration duct 18 for supplying cold air to the refrigeration compartment 15. The freezer duct 17 and the refrigeration duct 18 may be referred to as cold air ducts.

In detail, cold air holes are defined in plurality in the freezer duct 17, and cold air is discharged through the cold air holes into the freezer compartment 16. Here, the evaporator 31 and the blower fan 30 may be disposed in the freezer duct 17, or the evaporator 31 and the blower fan 30 may be disposed in a separate space, and the freezer duct 17 connected to the freezer compartment 16 may be separately formed.

The refrigeration duct 18 extends from the space in which the evaporator 31 is contained, passes through the barrier 111, and is connected to the refrigeration compartment 15. Here, the refrigeration duct 18 may either directly communicate with the space in which the evaporator 31 is contained, or may branch from the freezer duct 17.

In the above configuration, ice provided by the ice maker 20 mounted at the ceiling of the refrigeration compartment 15 is separated and falls into the ice bank 21. Here, to allow the ice separated from the ice maker 20 to reliably fall, a guide extending from the ice maker 20 or a guide extending from the ice bank 21 may be provided.

The refrigeration duct 18 communicates with the space in which the evaporator 31 is contained, and extends upward along the wall of the refrigeration compartment 15 to the ceiling portion of the refrigeration compartment 15. The end of the refrigeration duct 18 extends to the front of the refrigeration compartment 15 to be situated above the ice bank 21. Thus, the cold air that flows along the refrigeration duct 18 is discharged to the front, and a portion of the discharged cold air descends into the ice bank 21, while the remainder is circulated within the refrigeration compartment 15. Additionally, the cold air flowing through the refrigeration duct 18 may be discharged downward in the refrigeration compartment 15 to perform the function of a cold air curtain.

Figure 3:
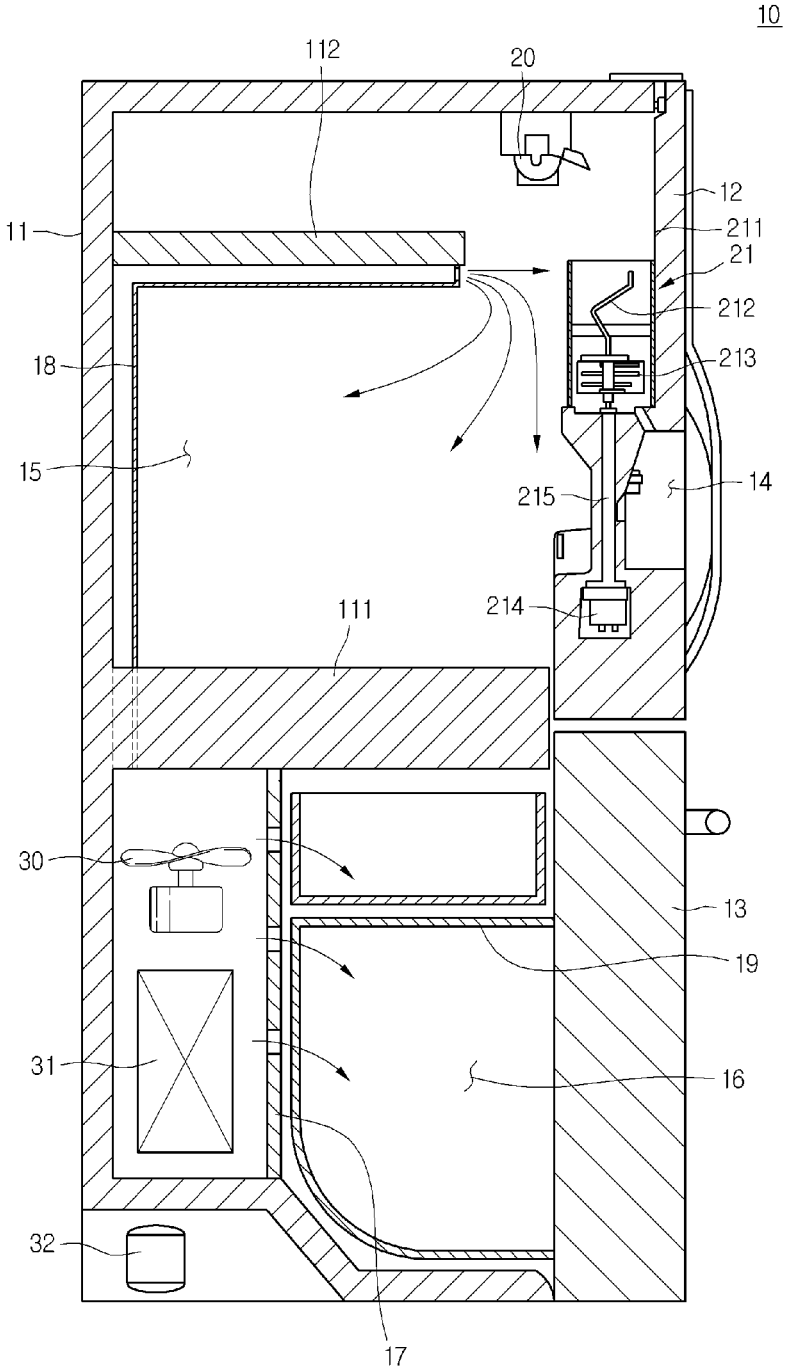
FIG. 3 is a side sectional view of a refrigerator according to another embodiment of the present disclosure.

FIG. 3 is a side sectional view of a refrigerator according to another embodiment of the present disclosure.

Referring to FIG. 3, the refrigeration duct 18 that discharges cold air into the ice bank 21 is characterized by extending forward along an undersurface of a shelf 112. Other configurative elements are the same as those in FIG. 2, and therefore, a description thereof will be omitted herefrom.

In detail, the refrigeration duct 18 extends from the space in which the evaporator 31 is contained, passes through the barrier 111, and is connected to the refrigeration compartment 15. In further detail, the refrigeration duct 18 extends upward along the rear surface of the refrigeration compartment, and extends forward along the undersurface of the shelf 112. Also, the outlet provided at the end of the refrigeration duct 18 is disposed above the ice bank 21. Accordingly, a portion of the cold air discharged from the refrigeration duct 18 is discharged into the ice bank 21, and the remainder circulates within the refrigeration compartment 15.

Figure 4:
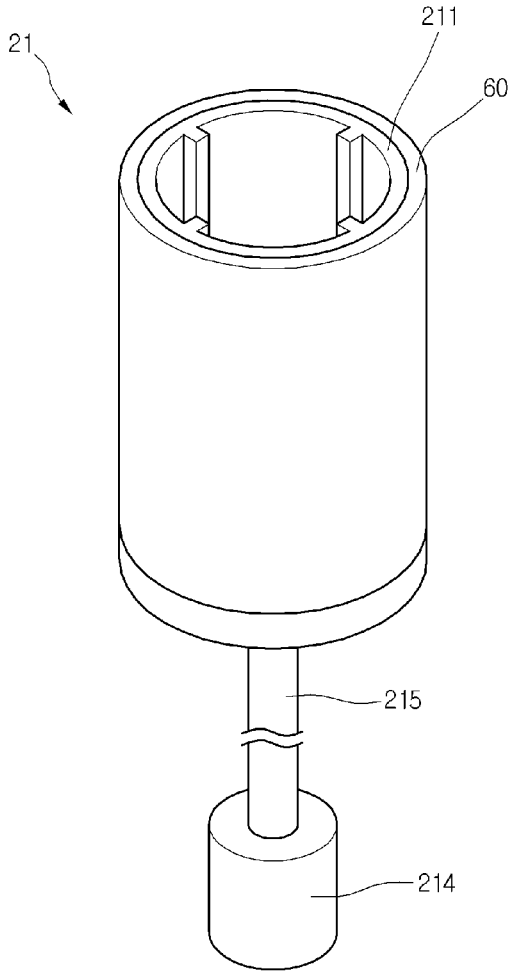
FIG. 4 is an external perspective view showing the structure of an ice bank according to an embodiment of the present disclosure.
Figure 5:
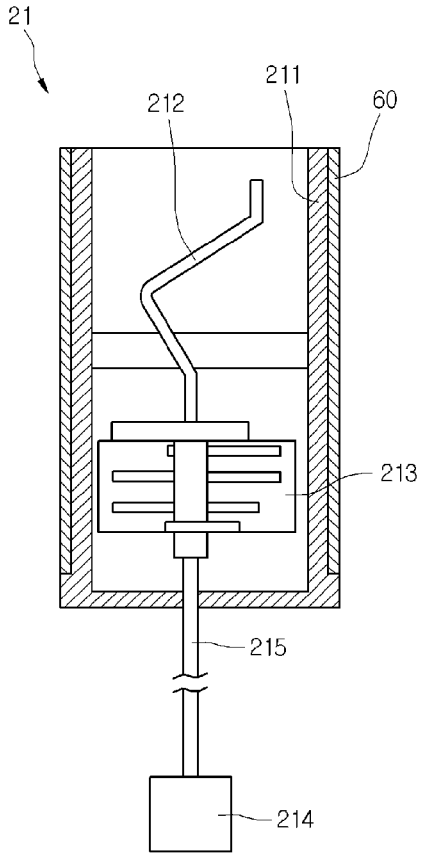
FIG. 5 is an upright sectional view of an ice bank according to an embodiment of the present disclosure.

FIG. 4 is an external perspective view showing the structure of an ice bank according to an embodiment of the present disclosure, and FIG. 5 is an upright sectional view of an ice bank according to an embodiment of the present disclosure.

Referring to FIGS. 4 and 5, an ice bank 21 according to the present disclosure includes a cylindrical container 211 open at the top, a cold accumulating member 60 surrounding the container 211, an auger 212 at the lower portion within the container 211 to guide ice downward, a crusher 213 integrally connected to the bottom end of the auger 212 to crush ice, a motor 214 driving the crusher 213, and a shaft 215 that connects the motor 214 and the crusher 213 to transmit the rotating force of the motor.

In detail, while the cold accumulating member 60 has been described as surrounding the outer periphery of the container 211, it is not limited thereto, and may surround the inner periphery of the container 211 or be filled within the walls of the container 211.

As a material for the cold accumulating member 60, a typical liquid cold accumulator may be used. For example, a cold accumulating material such as a potassium bicarbonate and ethyl alcohol mixture may be used. However, the cold accumulating material is not limited to any particular product.

By surrounding the container 211 with the cold accumulating member 60, the cold air discharged from the refrigeration duct 18 is stored in the cold accumulating member 60. Thus, the ice stored in the container 211 may be maintained in a frozen state without melting.

Figure 6:
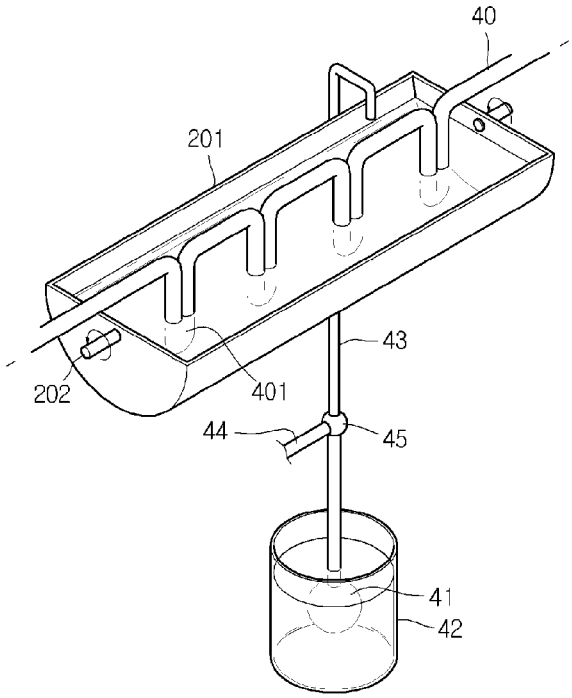
FIG. 6 is a perspective view of an ice maker that is installed in a refrigerator according to an embodiment of the present disclosure.

FIG. 6 is a perspective view of an ice maker that is installed in a refrigerator according to an embodiment of the present disclosure.

Referring to FIG. 6, an ice maker 20 provided in a refrigerator according to embodiments of the present disclosure includes a tray 201 for holding water to make ice, a freezing pipe 40 extending into the tray 201, and a water supplying device for supplying water to the tray 201.

Specifically, the water supplying device includes a water tank 42 that stores water, a pump 41 that pumps water within the water tank 42, and a water supplying pipe 43 extending from the pump 41 to the tray 201. Also, a dispenser connecting pipe 44 may be branched from a side of the water supplying pipe 43, whereupon a redirecting valve 45 may be installed at the branching point to selectively control the flow direction of water. In further detail, the dispenser connecting pipe 44 extends toward the dispenser to allow a user to dispense potable water. A pivoting axis 202 extends at both sides of the tray 201. The water tank 42 may be formed within the main body 11 or may be provided on a side of a wall of the refrigeration compartment 15.

The freezing pipe 40, as a pipe through which a portion of the refrigerant cycle is performed, is bent or curved a plurality of times to form a plurality of protruding portions 401, as shown. The protruding portions 401 are extended in a length enabling them to be immersed in water supplied to the tray 201.

To briefly describe an ice making process of the ice maker 20 in the above structure, first, water for drinking is supplied from an external water pipe to the water tank 42. Then, when the ice making process is begun, the pump 41 operates to supply water stored in the water tank 42 to the tray 201. When the water supplied to the tray 201 reaches a preset water level, the supplying of water is discontinued, and low temperature, low pressure refrigerant flows into the freezing pipe 40. The freezing pipe 40 may be configured to branch from a portion of the other pipes composing the refrigerant cycle of the refrigerator 10 and extend to the tray 201. For example, the freezing pipe may branch from a point on a pipe connected to the inlet of the evaporator 31 and extend to the tray 201. Also, the freezing pipe 40 may be further extended to the outlet of the compressor 32.

During the performing of the ice making process, the ice making is discontinued before ice forming on the protruding portions 401 contact ice formations on adjacent protruding portions 401. Then, the residual water in the tray 201 is removed. Here, methods for removing residual water may include rotating the tray 201 to remove the water, or connecting a separate drain pump to remove the residual water. When the removal of the remaining water is completed, the tray 201 is rotated 180°, in which state the ice is removed from the freezing pipe 40.

In detail, as a method for separating ice from the freezing pipe 40, high temperature refrigerant can be made to flow through the freezing pipe 40 during a defrosting process, or a heater may be attached to the surface of the freezing pipe 40 to heat the freezing pipe 40.

The ice separated in the above process either directly falls or descends via the guide into the ice bank 21. The ice that descends into the ice bank 21 is kept at a sub-zero temperature by cold air supplied from the refrigeration duct 18 or an auxiliary duct 28. That is, the ice chunks stored in the ice bank 21 are prevented from melting and sticking together.

Furthermore, even if the ice maker 20, configured with the freezing pipe extending into the inner space of the tray 201, is directly exposed to the atmosphere inside the refrigeration compartment, quick ice making can be realized. Accordingly, a separate insulating wall or insulating case structure for preventing the ice maker 20 from being exposed to the atmosphere within the refrigeration compartment is not required.

The invention claimed is:

1. A refrigerator, comprising:

a main body provided with at least a refrigeration compartment;

a door opening and closing the refrigeration compartment;

an ice maker mounted on a ceiling of the refrigeration compartment, the ice maker being exposed to the refrigeration compartment;

a container provided at a rear surface of the door to store ice separated from the ice maker, the container being exposed to the refrigeration compartment, and, when the door is closed, a top of the container being open and in communication with the refrigeration compartment;

a cold air duct directly discharging cold air generated by an evaporator disposed within the main body into the container, an outlet of the cold air duct being apart from the container; and a cold accumulating member surrounding the container and chilled by the cold air from the cold air duct so as to maintain the ice in a frozen state without melting, wherein the ice maker includes:

a tray storing potable water for making ice; and a refrigerant pipe extending into an inner space of the tray, and wherein ice is formed directly on a surface of the refrigerant pipe.

2. The refrigerator according to claim 1, wherein the cold accumulating member surrounds an inner periphery or an outer periphery of the container.

3. The refrigerator according to claim 1, wherein the cold accumulating member is buried in the container to surround the container.

4. The refrigerator according to claim 1, wherein the cold air duct extends along a ceiling surface of the refrigeration compartment.

5. The refrigerator according to claim 1, wherein the cold air duct extends along a rear wall surface and a ceiling surface of the refrigeration compartment, and has one end in communication with the evaporator and the other end disposed above the container.

6. The refrigerator according to claim 1 further comprising at least one shelf installed within the refrigeration compartment, wherein the cold air duct extends along a rear wall surface of the refrigeration compartment and along the shelf, and has one end in communication with the evaporator and the other end disposed above the container.

7. The refrigerator according to claim 5, further comprising a barrier dividing the refrigeration compartment from a freezer compartment, wherein the cold air duct passes through the barrier.

8. The refrigerator according to claim 1, further comprising a guiding member extending from a top of the container or from the ice maker, to guide ice falling from the ice maker into the container.

9. The refrigerator according to claim 1, wherein the container is mounted in a vertical direction on the rear surface of the door.

10. The refrigerator according to claim 6, further comprising a barrier dividing the refrigeration compartment from a freezer compartment, wherein the cold air duct passes through the barrier.

11. The refrigerator according to claim 1, where the cold accumulating member includes a mixture of potassium bicarbonate and ethyl alcohol.

* * * * *